US005313808A

United States Patent [19]

Scuderi

[11] Patent Number: 5,313,808

[45] Date of Patent: May 24, 1994

[54] PORTABLE REFRIGERANT RECYCLING UNIT FOR HEAT EXCHANGE WITH SEPARATE RECOVERY UNIT

[76] Inventor: Carmelo J. Scuderi, 173 Prospect St., Springfield, Mass. 01107

[21] Appl. No.: 30,589

[22] Filed: Mar. 11, 1993

[51] Int. Cl.[5] ..... F25B 43/04

[52] U.S. Cl. ..... 62/475; 62/292

[58] Field of Search ..... 62/77, 85, 149, 292, 62/475, 195

[56] References Cited

U.S. PATENT DOCUMENTS

| | | | |
|---|---|---|---|
| 4,766,733 | 8/1988 | Scuderi | 62/292 |
| 4,805,416 | 2/1989 | Manz et al. | 62/292 |
| 4,809,515 | 3/1989 | Honwink | 62/292 |
| 4,981,020 | 1/1991 | Scuderi | 62/292 |
| 5,078,756 | 1/1992 | Major et al. | 62/292 |
| 5,218,813 | 6/1993 | Keltner | 62/292 |
| 5,231,843 | 6/1993 | Keltner | 62/292 |
| 5,247,812 | 6/1993 | Keltner | 62/475 |

OTHER PUBLICATIONS

Technical Chemical Company-Sercon Refrigerant Recovery & Recycling Systems.

Robinair World-Choice SPX Corporation 1991 17150A Recycling System.

Standard Contracting Business Jan. 1993.

*Primary Examiner*—John M. Sollecito

*Attorney, Agent, or Firm*—Fishman, Dionne & Cantor

[57] ABSTRACT

A portable refrigerant recycle unit is disposed adjacent to a recycle (reclamation) unit for receiving excess or waste heat discharged therefrom. Liquid and gas refrigerant (e.g., freon) flow from the unit being evacuated to a heat exchanger. A fan draws discharged heat from the reclamation unit across the fins of the heat exchanger. Liquid freon flowing through the heat exchanger is vaporized as it is heated by the air drawn by the fan containing the heat discharged from unit. Gaseous freon flows from the heat exchanger to an oil seperator. Freon vapor then flows from the oil seperator through a filter to the recycle unit output. The reclamation unit condenses the recycle unit output of vapor freon to a liquid. The liquid freon flows from the output of the reclamation to a refrigerant receiver.

14 Claims, 2 Drawing Sheets

PORTABLE REFRIGERANT RECYCLING UNIT FOR HEAT EXCHANGE WITH SEPARATE RECOVERY UNIT

BACKGROUND OF THE INVENTION:

This invention relates to an apparatus for use when servicing cooling systems of the type utilizing a compressible refrigerant as the cooling medium. More particularly, this invention relates to a portable refrigeration recycling unit for use with a refrigeration reclamation (recovery) unit.

It is well known that the dumping of presently used refrigerants which consist of chlorofluorocarbons (CFC) is extremely damaging to the environment due to their deleterious effect on the ozone layer. Moreover, there is now worldwide agreement on regulating production and use of CFC's. As a result, the cost of CFC's, which is already high, will rise dramatically.

Recovery units (also referred to as reclamation units) are known. One such recovery unit is disclosed in U.S. Pat. Nos. 4,766,733 and 4,981,020, which are incorporated herein by reference. U.S. Pat. Nos. 4,766,733 and 4,981,022 disclose a refrigerant recovery and charging device which is connected between a refrigeration system to be charged or evacuated and a standard refrigerant receiver. A portion of the refrigerant being evacuated to continuously cool itself as the refrigerant travels between the refrigeration system to be evacuated and a storage receiver. As the refrigerant is cooled, the pressure thereon drops creating a pressure differential from the refrigeration system into the receiver.

While the terms recovery and reclamation have been used interchangeable herein and in U.S. Pat. Nos. 4,766,733 and 4,981,020, it is understood that reclamation is generally used for recovered refrigerant that has been treated and tested to meet standards for new refrigerant. This definition has not been applied in this and the above mentioned patents.

Recovery/recycle units are known, these units are large, heavy devices which are typically mounted on a wheel cart. The recovery/recycle units are generally not potable and include the recycle portion even when only recovery is desired.

Two-piece recovery/recycle units are known, these units comprise a recovery unit with a dedicated recycle unit. The recycle unit can only be used with the selected recovery unit and requires multiple refrigerant and electrical interconnections.

Recycle units are known and include filter and filter-/oil separation type units. The filter/oil separation units have a dedicated heat source sufficient for vaporization of the refrigerant. Accordingly, the recycle units are large, heavy units (often on wheel carts) and are not portable. The recycle units are designed to accept refrigerant from a recovery tank.

Despite the large number of reclamation (recovery) units, recovery/recycle units, two-piece recovery/recycle units and recycle units available, there continues to be a need for lighter more efficient units.

SUMMARY OF THE INVENTION

The above-discussed and other drawbacks and deficiencies of the prior art are overcome or alleviated by the portable refrigerant recycle unit of the present invention. In accordance with the present invention, the recycle unit is disposed adjacent to a recycle (reclamation) unit to utilize excess or waste heat discharged from the reclamation unit. Utilization of the excess heat from the reclamation unit significantly reduces the heating requirements of the recycle unit, thereby reducing the overall size, weight and cost of the recycle unit. Accordingly, this small, light weight recovery unit is truly portable and performs as well as the larger, heavier prior art units.

The recycle unit comprises an input connected to a heat exchanger having an oil seperator connected downstream therefrom. Separated oil is collected in an oil waste receptacle. A filter is provided downstream from the oil seperator. The filter output is connected to the output of the recycle unit.

During operation, the recycle unit is placed adjacent the reclamation unit for receiving discharged heat therefrom. Liquid and gas refrigerant (e.g., freon) flow from the unit being evacuated to the heat exchanger. A fan draws discharged heat from the reclamation unit across the fins of the heat exchanger. Liquid freon flowing through the heat exchanger is vaporized as it is heated by the air drawn by the fan containing the heat discharged from unit. Gaseous freon flows from the heat exchanger to the oil seperator. Freon vapor then flows from the oil seperator through a filter to the recycle unit output. The reclamation unit condenses the recycle unit output of vapor freon to a liquid. The liquid freon flows from the output of the reclamation to a refrigerant receiver. The recycle unit also provides means for sub-cooling the refrigerant receiver.

It will be appreciated that the recovery (reclamation) unit may also be a recovery/charging unit, whereby once a system has been evacuated and serviced it can be recharged with the same freon. It is preferred that the refrigerant be cleaned prior to recharging.

Prior art recovery/recycle units are large, heavy devices which are typically mounted on a wheel cart. These units are not portable and include the recycle portion even when only recovery is desired. Prior art two-piece recovery/recycle units comprise a recovery unit with a dedicated recycle units. These recycle units can only be used with the selected recovery units and require multiple refrigerant and electrical interconnections. Prior art recycle units include filter units and filter/oil seperator units. The filter/oil separation units have a dedicated heat source sufficient for vaporization of the refrigerant. Accordingly, the recycle units are large, heavy units (often on wheel carts) and are not portable. Moreover, these prior art recycle units are designed to accept refrigerant from a tank (i.e., refrigerant receiver) rather than in-line between a refrigeration system for evacuation and a recovery unit.

The above-discussed and other features and advantages of the present invention will be appreciated and understood by those skilled in the art from the following detailed description and drawings.

DESCRIPTION OF THE PREFERRED EMBODIMENT

Figure 1:
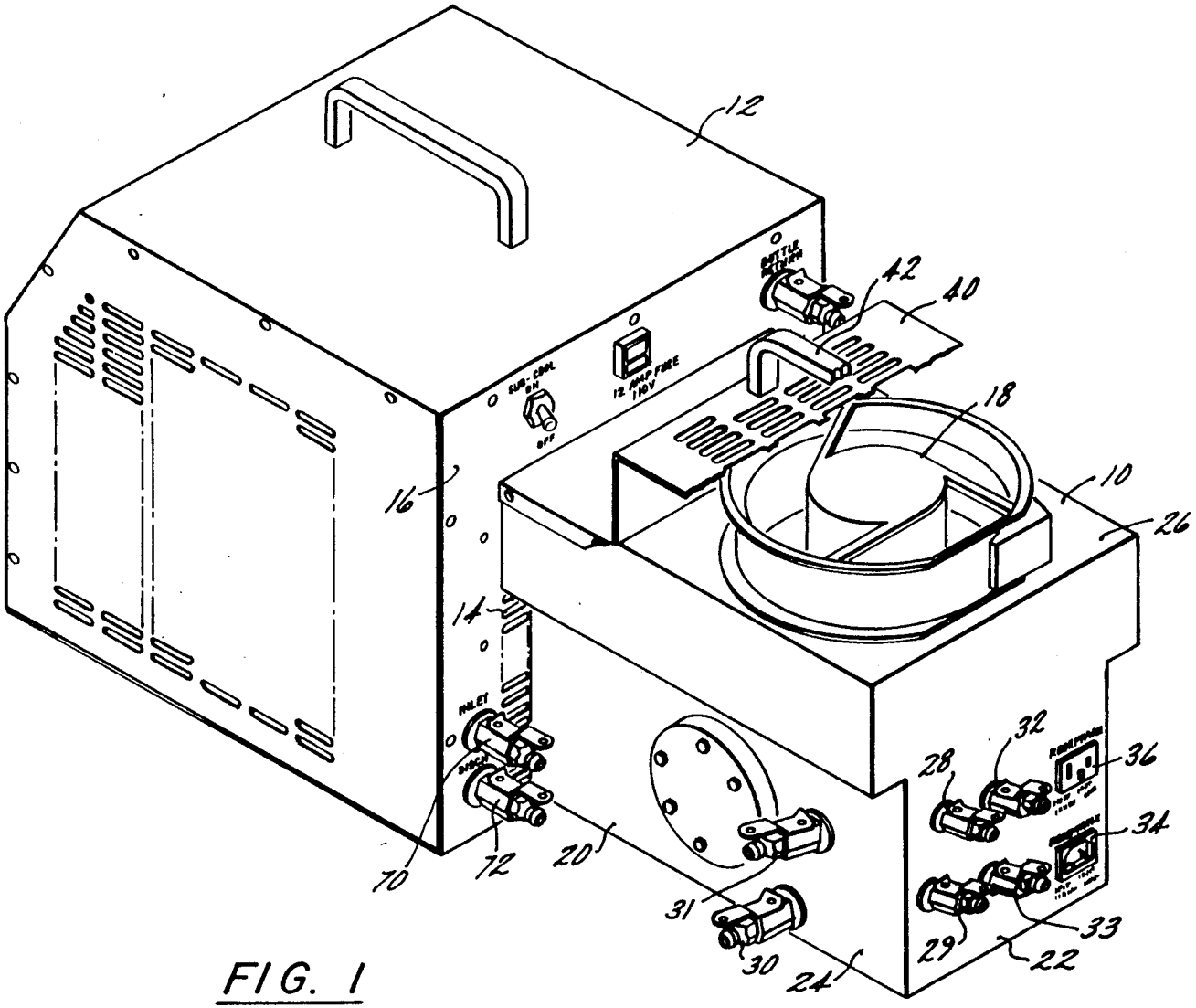
FIG. 1 is a diagramatic perspective view of a portable refrigeration recycle unit with a reclamation (recovery) unit in accordance with the present invention.

Referring to FIG. 1, a refrigerant recycle unit 10 in accordance with the present invention is shown disposed adjacent to a refrigerant recovery (reclamation) unit 12. Recycle unit 10 is disposed adjacent to reclamation unit 12 to utilize excess heat discharged from the reclamation unit, as will be more fully described hereinafter. Utilization of the excess heat from the reclamation unit significantly reduces the heating requirements of the recycle unit, thereby reducing the overall size, weight and cost of the recycle unit. Accordingly, this small, light weight recovery unit is truly portable and performs as well as the larger, heavier prior art units.

The excess heat from reclamation unit 12 is discharged through a plurality of vents 14 in a panel 16 of the unit, as is common with known reclamation (recovery) units: A plurality of vents (not shown) are found on the rear end panel of recovery unit 10 adjacent side 16 of reclamation unit 12 for receiving the discharged excess or waste heat. A fan 18 is provided to draw the excess heat from reclamation unit 12 through recycle unit 10.

Recycle unit 10 is compatible with most known reclamation (recovery) units. Reclamation unit 12 may be of the type described in U.S. Pat. Nos. 4,766,733 and 4,981,020 commercially available from Thermaflo, a division of American Thermaflo Corporation as "OZ SAVER LIGHT" (a trademark of THERMAFLO), however, other recovery (reclamation) units are compatible with the recycle unit of the present invention, for example, Dupont "RRU30"; National Refrigeration Products "LV1"; Recycling Specialists International "LIT'L SUCKER"; Robinair "17625"; and White Industries "01640".

Recycle unit 10 comprises a housing 20 having opposing front and rear panels 22, opposing sides panels 24, and top and bottom panels 26. The rear panel includes vents for receiving discharge heat from a reclamation unit, the front panel has ports 28–32 and power receptacles 34, 36 disposed thereon. Side panel 24 has a port 38 disposed thereon. Fan 18 is mounted over an opening through the top panel. A vented cover 40 having a handle 42 is mounted to panel 26.

Figure 2:
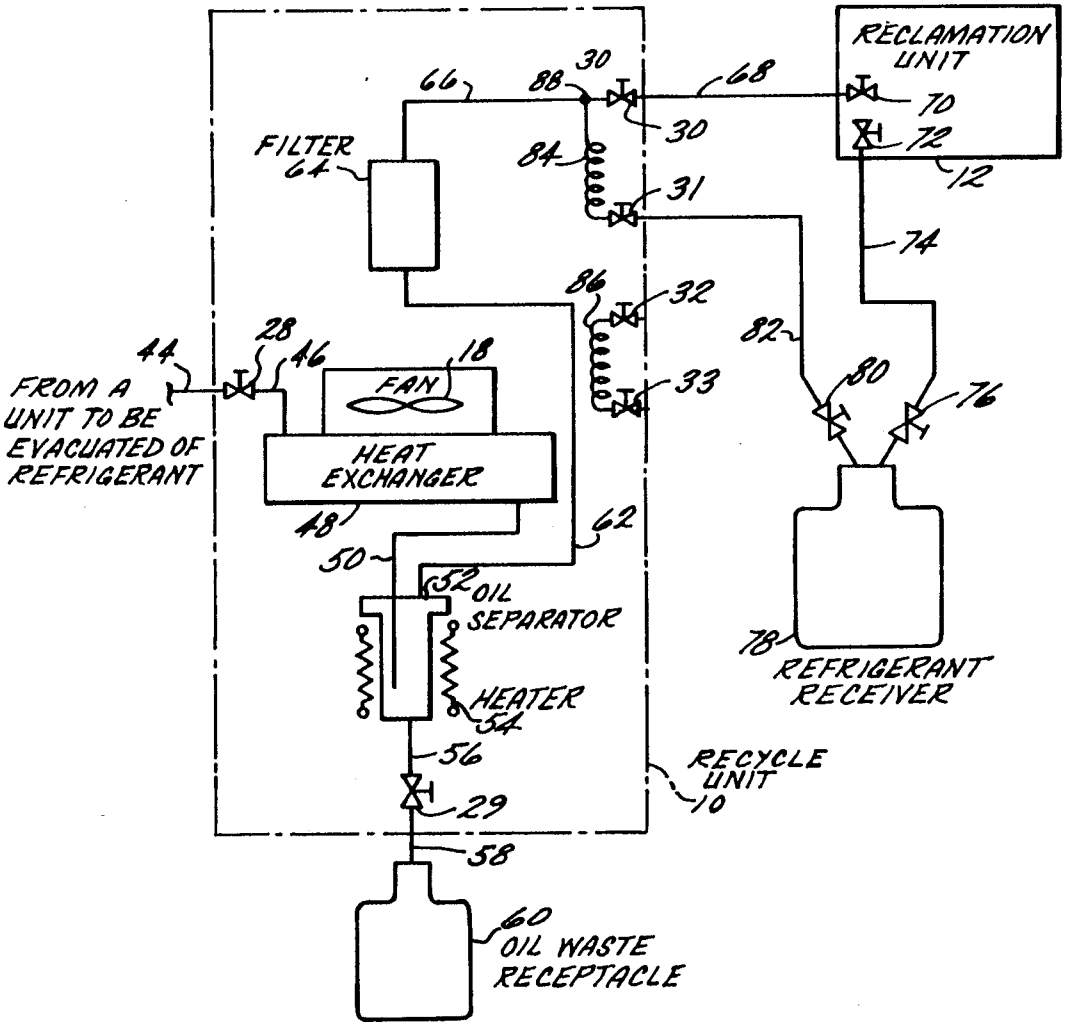
FIG. 2 is a schematic drawing of the portable refrigeration recycle unit of FIG. 1.

Referring now to FIG. 2, a schematic diagram of recycle unit 10 is shown. A refrigeration system (not shown) from which a compressible refringement is to be evacuated is connected by a line 44 to input port 48 which is connected by a line 46 to a heat exchanger 48. Heat exchanger 48 is connected by a line 50 to an oil seperator 52 which has a heater 54 disposed thereabout. Oil seperator 52 is connected by a line 56 to output port 29 which is connected by a line 58 to an oil waste receptacle 60. Oil seperator 52 is also connected by a line 62 to a filter 64 which is connected by a line 66 to output port 30. Filter 64 is preferably a Thermaflo "FP100-4", although other commercially available filters may be employed (e.g., Sporlan "C-485" or Alco Controls "A2F-D").

Recycle unit 10 is connected at output port 30 by a line 68 to an input port 70 of reclamation unit 12. An output port 72 of reclamation unit 12 is connected by a line 74 to a port 76 of a refrigerant receiver 78. Refrigerant receiver 78 comprises a known type refrigerant receiver such as described in U.S. Pat. Nos. 4,766,733 and 4,981,020. Refrigerant receiver 78 is connected at a port 80 by a line 82 to port 31 of recycle unit 10. A first capillary tube 84 in recycle unit 10 is connected between ports 30 and 31. A second capillary tube 86 in recycle unit 10 is connected between port 32 and 33.

During operation, recycle unit 10 is placed adjacent reclamation unit 12 for receiving discharged heat from unit 12 as is clearly shown in FIG. 1. All ports are opened and liquid and gas refrigerant (e.g. freon) flow from the unit being evacuated through lines 44 and 46 to heat exchanger 48. Fan 18 draws discharged heat from unit 12 across the fins (not shown) of heat exchanger 48. Liquid freon flowing through heat exchanger 48 is vaporized as it is heated by the air drawn by fan 18 containing the heat discharged from unit 12. As discussed hereinbefore, this is an important feature of the invention since it eliminates the need of a separate heat source as is required in the prior art recycle units.

Gaseous freon flows from heat exchanger 48 to oil seperator 52. The vapor flow velocity of the freon is reduced in oil seperator 52 to allow the oil seperator to occur. The separated oil flows through line 56, 58 into oil waste receptacle 60. The separated oil also captures any acid contaminated oil as the acid has an affinity for the oil. Oil seperator 52 is also heated by the air drawn by fan 18 containing the heat discharged from unit 12. Efficient oil-freon vapor separation is assured by the use of band heater 54 about oil seperator 52. Heater 54 further vaporizes any remaining liquid freon. However, it will be appreciated, that heater 54 does not provide heat for the heat exchanger 48 and does not provide sufficient heat in and of itself to sufficiently vaporize the refrigerant in accordance with the present invention.

Freon vapor then flows from oil seperator 52 along line 62 through filter 64 which removes remaining oil, acid and water contaminates while providing ten micron particulate filtration of the freon vapor. The filtered freon vapor flows from output Port 30 to input port 70 of unit 12. Reclamation unit 12 provides the motive force for moving the recycled refrigerant through the system. Reclamation unit 12 condenses the vapor freon to a liquid. The liquid freon flows from output port 72 of unit 12 to refrigerant receiver 78 via port 76. As is known, a portion of the refrigerant in receiver 78 will still be vapor.

Accordingly, this vapor is drawn from receiver 78 and feedback through unit 12. Vapor freon in receiver 78 flows from port 90 to port 31 on recycle unit 10. This vapor passes through capillary tube 84 which restricts the vapor flow from receiver 78. Restricted vapor flow from tube 84 is combined with the filtered vapor flow in line 66 at a tee 88 and condensed to a liquid in unit 12 and flows into receiver 78 as described above. This feedback loop results in sub-cooling of receiver 78. While it is preferred that receiver 78 be continuously sub-cooled, as described above, the sub-cooling can be shut off by closing port 80 and/or port 31. Also intermittent sub-cooling of receiver 78 can be accomplished by closing port 44 and allowing unit 12 to suck vapor from receiver 78 through tube 84, whereby only the vapor from receiver 78 is condensed to a liquid in unit 12 and returned to receiver 78.

In the event the reclamation unit 12 is not sufficiently condensing the freon vapor a pressure drop can be added in line 74 (i.e., the fluid output of unit 12). Although not shown, this is accomplished by connecting port 72 of unit 12 to port 32 of unit 10 and connecting port 33 of unit 10 to port 76 of receiver 78. This basically introduces capillary tube 86 into line 74. This pressure drop will force unit 12 to further condense the outlet freon flow, whereby mostly liquid freon (i.e., refrigerant) will enter receiver 78.

Figure 3:
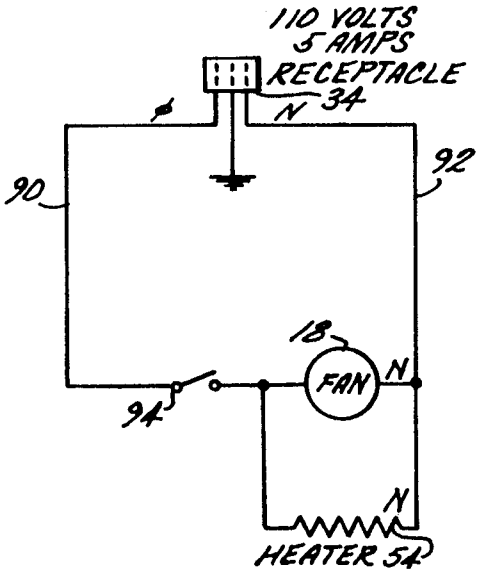
FIG. 3 is an electrical schematic for the portable refrigerant recycle unit of FIG. 1.

Referring to FIG. 3, an electrical schematic for recycle unit 10 is shown. Receptacle 36 is preferably a 110 volt 5 amp receptacle. Receptacle 36 is connected by signal lines 90, 92 to fan 18 and heater 54. A switch 94 is provided in line 90 to actuate fan 18 and heater 54. It will be appreciated that recycle unit 10 does not require any electrical connection to reclamation unit 12.

While unit 12 has only been described for recovery (reclamation) it is known in the art that the unit may also be a charging unit, for example, as described in U.S. Pat. Nos. 4,766,733 and 4,981,020. More specifically, once a system has been evacuated and serviced it can be recharged with the same freon. While it is known to recharge systems with the old refrigerant, it is preferred that the refrigerant be cleaned prior to recharging. The portable recycle unit of the present invention adds this cleaning capability to prior art reclamation (recovery)/-charging units. Recycle unit 12 is versatile in that it is directly compatible with prior art reclamation (recovery)/charging units having a vented heat exhaust and refrigerant inlet and outlet connections. Further, it is truly porable since it weighs less than twenty pounds. Units in excess of thirty-five pounds are typically difficult to handle, particularly when climbing ladders, as is often required since many cooling (refrigeration) systems are located on roofs.

Accordingly, the recycle unit of the present invention provides many advantages over the prior art:

(1) the recycle unit is universal in that it can be used with any recovery system (as described hereinbefore), (2) the recycle unit is truly portable;

(3) the recycle unit eliminates the need of a separate heating unit for vaporizing the liquid refrigerant since it utilizes discharged waste heat from the recovery unit; and (4) the recycle unit is lighter and less expensive as a result of the elimination of the separate heating unit.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A refrigerant recycle unit for use with a separate refrigerant recovery unit for recycling and recovering compressible refrigerant from a refrigeration system, the refrigerant recovery unit having refrigerant recovery input and output means, the refrigerant recovery output means delivers the recovered refrigerant to a refrigerant receiver, the refrigerant recovery unit discharges heat when recovering the refrigerant, said refrigerant recycle unit comprising:

refrigerant input means for receiving the refrigerant from the refrigeration system;

heat receiving means for receiving the heat discharged from the separate refrigerant recovery unit;

heat exchanger means for transferring the heat from said heat receiver means to the refrigerant from said refrigerant receiver to vaporize the refrigerant;

oil separator means downstream from said heat exchanger means for separating oil from the vaporized refrigerant;

filter means downstream from said oil seperator means for filtering the vaporized refrigerant; and refrigerant output means for presenting the vaporized refrigerant from said filter means to the refrigerant recovery input means.

2. The refrigerant recycle unit of claim 1 further comprising:

means for sub-cooling the refrigerant receiver.

3. The refrigerant recycle unit of claim 2 wherein said sub-cooling means comprises:

sub-cooling input means for receiving vapor refrigerant from the refrigerant receiver; and vapor flow restriction means for restricting the vapor refrigerant flow from said sub-cooling input means to said refrigerant output means.

4. The refrigerant recycle unit of claim 3 wherein said vapor flow restriction means comprises:

a capillary tube connected between said sub-cooling input means and said refrigerant output means.

5. The refrigerant recycle unit of claim 1 further comprises:

heater means for heating said oil seperator means.

6. The refrigerant recycle unit of claim 5 wherein said heat means comprises a band heater disposed about said oil seperator means.

7. The refrigerant recycle unit of claim 1 wherein said heat exchanger means comprises a fin tube heat exchanger.

8. The refrigerant recycle unit of claim 1 further comprising:

means for housing said refrigerant input means, said heat receiving means, said heat exchanger means, said oil seperator means, said filter means, and said refrigerant output means.

9. The refrigerant recycle unit of claim 8 wherein said heat receiving means comprises;

vent means in said housing means at a location adjacent the recovery unit, said vent means being receptive to the heat discharged from the recovery unit; and fan means disposed on said housing means for drawing air containing the heat discharged from the recovery unit through said vent means for use by said heat exchanger means.

10. The refrigerant recycle unit of claim 1 further comprising:

flow restriction means including means for connecting said flow restriction means between the refrigerant recovery output means and the refrigerant receiver.

11. The refrigerant recycle unit of claim 10 wherein said flow restriction means comprises a capillary tube.

12. The refrigerant recycle unit of claim 1 wherein said oil seperator means reduces the velocity of the vaporized refrigerant flow and transfers the heat from said heat receiver means to the vaporized refrigerant for separating oil from the vaporized refrigerant.

13. A refrigerant recycle unit for use with a separate refrigerant recovery unit for recycling and recovering compressible refrigerant from a refrigeration system, the refrigerant recovery unit having refrigerant recovery input and output means, the refrigerant recovery output means delivers the recovered refrigerant to a refrigerant receiver, the refrigerant recovery unit discharges heat when recovering the refrigerant, said refrigerant recycle unit comprising:

refrigerant input means for receiving the refrigerant from the refrigeration system;

heat receiving means for receiving the heat discharged from the separate refrigerant recovery unit;

heat exchanger means for transferring the heat from said heat receiver means to the refrigerant from said refrigerant receiver to vaporize the refrigerant;

oil separator means downstream from said heat exchanger means for separating oil from the vaporized refrigerant;

filter means downstream from said oil seperator means for filtering the vaporized refrigerant;

refrigerant output means for presenting the vaporized refrigerant from said filter means to the refrigerant recovery input means;

sub-cooling input means for receiving vapor refrigerant from the refrigerant receiver;

vapor flow restriction means for restricting the vapor refrigerant flow from said sub-cooling input means to said refrigerant output means;

heater means for heating said oil seperator means;

means for housing said refrigerant input means, said heat receiving means, said heat exchanger means, said oil seperator means, said filter means, said refrigerant output means, said sub-cooling input means, said vapor flow restriction means, and said heater means; and wherein said heat receiving means comprises;

vent means in said housing means at a location adjacent the recovery unit, said vent means being receptive to the heat discharged from the recovery unit, and fan means disposed on said housing means for drawing air containing the heat discharged from the recovery unit through said vent means for use by said heat exchanger means.

14. The refrigerant recycle unit of claim 17 wherein said oil seperator means reduces the velocity of the vaporized refrigerant flow and transfers the heat from said heat receiver means to the vaporized refrigerant for separating oil from the vaporized refrigerant.

* * * * *